United States Patent [19]

Seltveit

[11] Patent Number: 4,536,273

[45] Date of Patent: Aug. 20, 1985

[54] DIFFUSION BARRIER FOR ALUMINIUM ELECTROLYSIS FURNACES

[75] Inventor: Arne Seltveit, Trondheim, Norway

[73] Assignee: Sintef, Trondheim, Norway

[21] Appl. No.: 556,237

[22] PCT Filed: Mar. 4, 1983

[86] PCT No.: PCT/NO83/00007

§ 371 Date: Oct. 19, 1983

§ 102(e) Date: Oct. 19, 1983

[87] PCT Pub. No.: WO83/03106

PCT Pub. Date: Sep. 15, 1983

[30] Foreign Application Priority Data

Mar. 5, 1982 [NO] Norway ..... 820694

[51] Int. Cl.[3] ..... C25C 3/08; C01B 33/26; C04B 35/10; C04B 35/16

[52] U.S. Cl. ..... 204/243 R; 423/327; 501/127

[58] Field of Search ..... 204/243 R, 244–247, 204/67; 423/327–328; 501/127–128

[56] References Cited

U.S. PATENT DOCUMENTS

| | | | |
|---|---|---|---|
| 3,723,286 | 3/1973 | Hunt et al. | 204/243 R |
| 3,764,509 | 10/1973 | Etzel et al. | 204/243 R |
| 4,175,022 | 11/1979 | Vadla et al. | 204/243 R |
| 4,411,758 | 10/1983 | Hess et al. | 204/243 R |

*Primary Examiner*—Donald R. Valentine

*Attorney, Agent, or Firm*—Wenderoth, Lind & Ponack

[57] ABSTRACT

Diffusion barrier for electrolysis furnaces for the preparation of aluminium by electrolysis of alumina dissolved in a fluoride melt. The diffusion barrier comprises a material which reacts with sodium fluoride to form compounds which are solid at the operation temperature of the furnace.

4 Claims, 3 Drawing Figures

DIFFUSION BARRIER FOR ALUMINIUM ELECTROLYSIS FURNACES

The invention relates to a diffusion barrier for the bottom lining of electrolysis furnaces for the preparation of aluminium by electrolysis of alumina according to the Hall-Heroult process. If desired, said diffusion barrier may represent the only insulating lining in the furnace. The diffusion barrier is intended to form a barrier against liquid metal and particularly against liquid and gaseous bath components which normally penetrate into the lining through the pore system, joints and cracks in the materials involved. As a consequence of the penetration the heat conductivity of the lining will increase, and the heat loss from the furnace will increase. Metal and bath components may also react with the insulating materials in the lining, and the reaction products may be of low viscosity and penetrate further downwards into the lining.

According to Chapman, J. C. and Wilder H. J., Light Metals, 1978, vol. 1, page 303 the methods which have previously been used to prevent—or limit—the penetration into the insulating lining of aluminium electrolysis furnaces, may be divided into three main groups:

(a) A layer of compacted alumina powder is used.

(b) A layer of refractory bricks of low porosity has been interposed between the cathode (carbon lining) and the insulating bricks.

(c) Metal sheets preventing penetration for a certain period have been included, whereby a dense layer ("crust") is formed through the reaction between the alumina and the bath components present.

Chapman and Wilder have described a diffusion barrier of a flexible graphite material, "Grafofil" from Union Carbide Corporation, supported by a thin steel sheet which also serves as a barrier against sodium gas.

From U.S. Pat. Nos. 3,773,643 and 3,779,699 it is known to use sheet glass as a diffusion barrier in electrolysis furnaces for the preparation of aluminium by electrolysis of aluminium chloride. However, such sheets may suitably also be used in the electrolysis of alumina dissolved in a fluoride melt.

Although the use of sheet glass represents an essential improvement it will not always provide a complete safeguarding against the leakage of liquid bath components, particularly sodium fluoride. This is particularly the case if cracks in the glass or gaps between the glass sheets should occur so that the glass does not bond sufficiently together. Thus, there exists a need for a further safeguarding against the leakage of liquid material and penetration into the insulating lining underneath.

According to the present invention there may be established a diffusion barrier, possibly in combination with sheet glass, of materials (bricks, insulating bricks or granular materials) having such a composition that upon reaction with penetrating sodium fluoride-containing melt they form solid compounds at the operation temperature of the furnace. Thereby the amount of molten phase is reduced so that melt infiltration of the insulating lining underneath is inhibited or prevented. As a further safeguarding against penetration a metal sheet may also be placed on the underside, possibly on the underside of the sheet glass if such is used, or the metal sheet may be interposed between two glass sheets.

BRIEF DESCRIPTION OF THE DRAWING

Examination—see for instance Dell, M. B., J. Met. 23, 18 (1971)—of materials from used bottom linings of aluminium electrolysis furnaces indicates that the molten phase which has come in contact with the insulating lining consists of cryolite, $Na_3AlF_6$, with a certain excess of sodium fluoride, and minor amounts of dissolved calcium fluoride, $CaF_2$, and alumina, $Al_2O_3$. The eutectic temperature in the partial system NaF—$CaF_2$—$Na_3AlF_6$ has been determined (Fedotieff, P. P., Iljinsky, W. P., Z. anorg. Allgem. Chem. 129, 93 (1923)) to be about 780° C., and the eutectic composition may be read to be about 70.2 percent NaF, 6.4 percent $AlF_3$ and 23.4 percent $CaF_2$ on a molar basis (cf. FIG. 1, point $E_1$). This corresponds to 55.5 percent by weight of NaF, 10.1 percent by weight of $AlF_3$ and 34.4 percent by weight of $CaF_2$. The melting points of the pure components are NaF: about 995° C.

$CaF_2$: 1423° C.

$Na_3AlF_6$: 1002° C.

Figure 1:
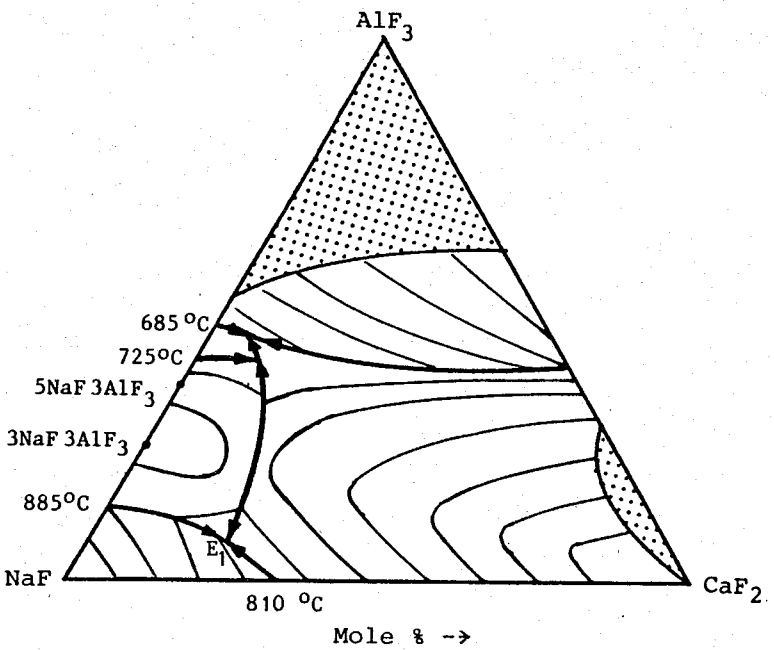
FIG. 1 is a phase diagram.

A typical temperature under the cathode, the carbon lining, in an aluminium electrolysis furnace is 900° C. It appears from the phase diagram illustrated in FIG. 1, that if the NaF in the melt can be reacted so that practically all fluoride is bound as $CaF_2$, the amount of molten phase at 900° C. may be reduced drastically if the newly formed sodium compound has a low solubility in the melt phase.

On the basis of thermodynamic data it may be shown that reactions leading to such a "drying" of the melt phase as described above may take place if the melt is in contact with calcium aluminium silicates such as anorthite, $CaO.Al_2O_3.2SiO_2$, gehlenite, $2CaO.Al_2.SiO_2$, or mixtures of calcium silicates such as wollastonite, $CaO.SiO_2$ and corundum, $Al_2O_3$. Pure calcium silicates may also be used, but will hardly be as effective with respect to reduction of the amount of molten phase as materials which in addition to CaO and $SiO_2$ also contain $Al_2O_3$.

The equilibriums established may be illustrated in different ways. As examples, the reaction between anorthite and sodium fluoride, and the reaction between cryolite and materials consisting of anorthite and gehlenite are illustrated in the following.

$$CaO.Al_2O_3.2SiO_2(s) + 2NaF(s) = Na_2O.Al_2O_3.2SiO_2(s) + CaF_2 \quad (1.)$$

(Nepheline)

$$\Delta G^o_{1200K} = -10.6 \text{ kcal}$$

$$2(CaO.Al_2O_3.2SiO_2)^* + 2(2CaO.Al_2O_3.SiO_2)^* + 2Na_3AlF_6 = 6CaF_2 + 3(Na_2O.Al_2O_3.2SiO_2) + 2Al_2O_3 \quad (2.)$$

$$\Delta G^o_{1200K} = -25 \text{ kcal}$$

*Formed in situ from wollastonite and corundum

In order to establish whether the reactions discussed above will take place at 900° C. several experiments were carried out on a laboratory scale. The first experiments were carried out with compressed cylinders of powder mixtures of the fluorides and silicates in question. The cylinders were kept 1–3 days at 900° C. in a carbon crucible and were then examined by means of X-ray diffractometer. The results clearly showed that at the temperature in question the reactions took place exactly as predicted. Fluoride was always recovered as $CaF_2$, and $Na_2O$ had passed into the silicate phases.

There were also several experiments carried out in which fired samples having a composition within the system $CaO—Al_2O_3—SiO_2$ (with molar ratio 1:0.25–2:0.25–4 particularly 1:0.5–1:0.5–2) were exposed to melts having a eutectic composition in the partial system $NaF—CaF_2—Na_3AlF_6$. As an example of such experiments, a single experiment will be described further herein.

Porous cylindrical samples were prepared from a mixture consisting primarily of $CaCO_3$, $Al_2O_3$ and $SiO_2$, of such a composition that, after firing theoretically should consist of pure anorthite. The X-ray diffractogram of the fired material showed that they practically only consisted of anorthite, but there is some unreacted $\alpha$-corundum.

Figure 3:
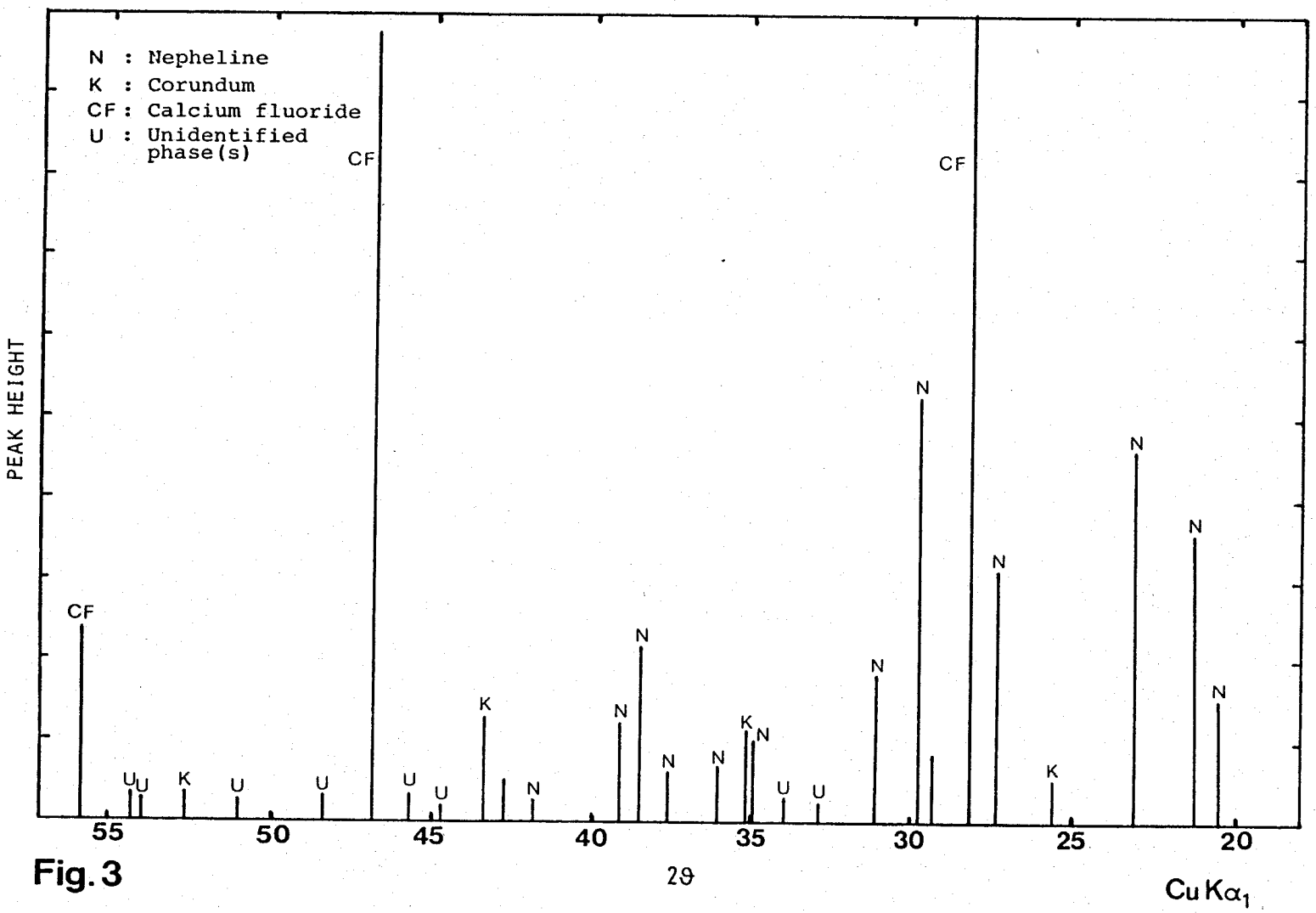
FIG. 3 illustrates an X-ray diffractogram of a sample obtained in a experiment described below.

At the top of the samples—which had a diameter=-height=50 mm—there was a hole drilled about 10 mm deep having a diameter of 10 mm. The hole was filled with powder obtained by grinding a fused fluoride melt having the previously stated eutectic composition. The test cylinder with ground fluoride was heated in an inert atmosphere to 900° C. and kept at this temperature for 24 hours. The test cylinder was then cooled and new fluoride powder was filled into the hole. (The melt had penetrated into the pores of the material). After renewed heating and exposure for 24 hours the test cylinders were taken out for analysis. Also in this case practically all the melt had been absorbed in the pores of the material. The top of the cylinder had cracked radially from the hole, which indicates that the reaction had entailed volume expansion. The X-ray diffractogram of material taken close to the hole in the cylinder shows that it now consists of $CaF_2$, $Na_2O.Al_2O_3.2SiO_2$ and some $\alpha$-$Al_2O_3$. Sodium fluoride or cryolite cannot be detected, and the result shows that the expected mineral reaction has taken place (cf. FIG. 3).

The above calculations and experiments indicate that if insulating materials of the type described herein are used in the bottom of the electrolysis furnaces—or in any case in the upper part of the lining—it should be possible to stop the melt seepage high up in the lining. In practical use, materials should be selected with suitable porosity in view of the temperature gradient desired, and it must be taken into consideration that the reactions entail volume expansion. For said reason it may for instance be practical to use granular materials (powder, granules) of synthetic or natural minerals in the upper part of the lining, i.e. the layer which is most adjacent to the cathode. Further, material compositions must be chosen which do not contain mineral phases which absorb water during storage or installation. Examples of such phases in the system in question are free CaO and $3CaO.SiO_2$.

Another important feature in the use of materials which by reaction bind the fluorides as calcium fluoride is that the environmental pollution from discarded used furnace linings will be reduced. This is immediately seen from the values of the solubility of the fluoride salts in water. The solubility of $CaF_2$ is stated to be 0.0016 g per 100 g of water at 20° C., and for NaF the solubility is 4.1 g per 100 g of water.

If a glass sheet is used, its function is primarily to prevent the melt from flowing so rapidly downwards into the lining that the desired mineral reaction does not take place in the upper part of the lining. It is particularly favourable to use a glass sheet—and possibly a metal sheet—if granular materials are used as the top layer. The glass sheet is then placed underneath or under the first or second layer of bricks counted from the top of the insulating lining.

The composition of the glass sheets may vary within the field $SiO_2$: 40–100%
$Na_2O$: 0–30%
$K_2O$: 0–30%
CaO: 0–50%
$Al_2O_3$: 0–20%
$B_2O_3$: 0–30%.

Preferably ordinary window glass qualities are used of the composition $SiO_2$: 70–75%
$Na_2O$: 5–15%
CaO: 5–15%
$Al_2O_3$: 0–5%

Figure 2:
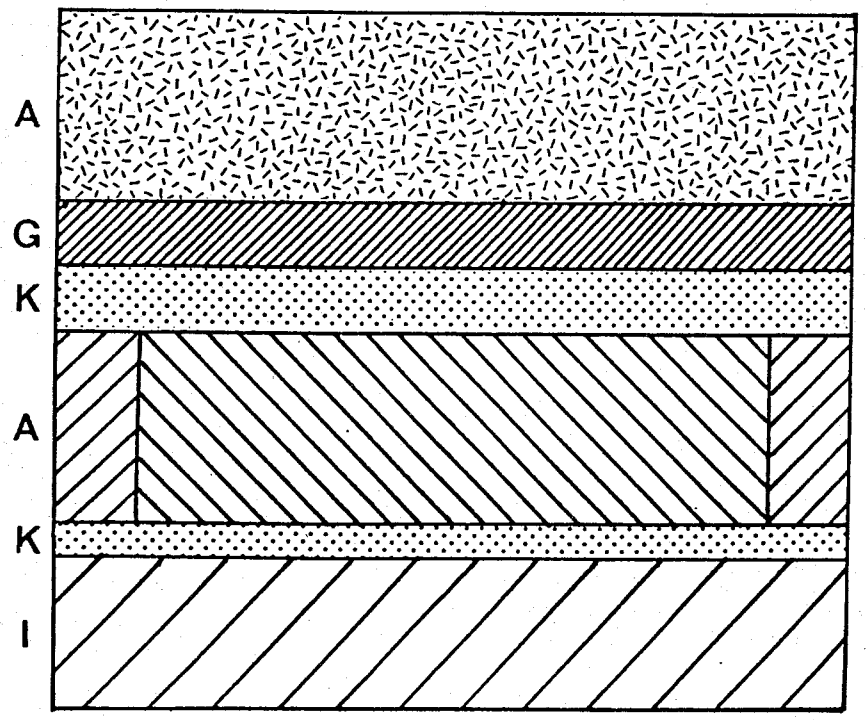
FIG. 2 illustrates the construction of a diffusion barrier of the present invention.

FIG. 2 illustrates a preferred construction of a diffusion barrier in an electrolysis furnace. In the figure the different parts have been designated as follows:

A=anorthite
G=glass
K=corundum
I=insulating brick

With respect to the metal sheet which may be incorporated in the diffusion barrier, a metal or a metal alloy should be chosen which has a higher melting point—or solidus temperature—than the maximum temperature at the level at the lining in which the diffusion barrier is present, preferably also higher than the operating temperature in the furnace (furnace pot).

The glass sheet on both sides of the metal sheet will, during operation, be present as an enamel on the metal sheet. Thereby a possible oxidation of the metal sheet is limited, and direct contact between the metal sheet and metal which penetrates from the charge or which is formed in the lining due to reactions between the lining material and bath components is prevented. It is for instance known from aluminium electrolysis furnaces that metallic aluminium which penetrates down through the carbon lining forms alloys with the iron in the current leads.

Temperature measurements in the bottom lining of aluminium electrolysis furnaces show, as mentioned, that under regular operation the temperature immediately below the carbon lining is about 900° C. Experiments in a laboratory furnace have shown that at this temperature the viscosity of ordinary window glass is so relatively low shortly after the heating that the glass will gradually flow out over a substrate of a refractory fiber board. Two sheets adjacent to each other will become fused to form a dense, homogeneous joint. Further, the experiments have shown that window glass with a suitable composition will gradually start crystallizing when kept at temperatures within the operating temperature interval for a prolonged period of time. A glass sheet kept at 900° C. for two days had become milky white and opaque. Another glass sheet kept for seven days at 900° C. had become completely white and typically crystalline.

The crystallization entails an increase in the viscosity of the glass, which is considered as favourable for the use in question. Due to uneven temperature distribution—and thereby uneven expansion—in the insulating lining, the top surface thereof will not remain completely flat and horizontal. The glass in the diffusion barrier should therefore be able to become deformed without cracking, but at the same time the viscosity must be sufficiently high that the glass does not flow down into pores in the lining material underneath.

In order to obtain the desired viscosity of the glass shortly after the furnace has been started, it is possible to choose between different qualities of glass, and the glass may be incorporated at different levels in the lining. Normally the lining has a known temperature gradient, and with a chosen quality of glass the glass may be incorporated in such a manner that the glass before crystallization acquires the desired viscosity or flowability.

I claim:

1. A diffusion barrier for an electrolysis furnace for the preparation of aluminium by electrolysis of alumina dissolved in a fluoride melt, which diffusion barrier comprises at least one material selected from the group consisting of calcium aluminium silicates and mixtures of a calcium silicate and $Al_2O_3$ which do not absorb water and which react with sodium fluoride to form compounds which are solid at the operation temperature of the furnace.

2. The diffusion barrier according to claim 1, wherein the calcium aluminium silicates contain CaO, $Al_2O_3$ and $SiO_2$ in the molar ratio 1:0.25–2:0.25–4.

3. The diffusion barrier according to claim 2, wherein the molar ratio is 1:0.5–1:0.5–2.

4. The diffusion barrier according to claim 3, wherein said material is anorthite.

* * * * *